United States Patent [19]

Gerard

[11] Patent Number: 4,645,694

[45] Date of Patent: Feb. 24, 1987

[54] PROCESS OF GALVANIZING FOR CONSECUTIVELY PRODUCING TWO DIFFERENT COATINGS ON A METAL BAND

[75] Inventor: Guy Gerard, Louvroil, France

[73] Assignee: Fabrique de fer de Maubeuge, Louvroil, France

[21] Appl. No.: 804,657

[22] PCT Filed: Jul. 23, 1984

[86] PCT No.: PCT/FR84/00176

§ 371 Date: Nov. 15, 1985

§ 102(e) Date: Nov. 15, 1985

[87] PCT Pub. No.: WO85/04427

PCT Pub. Date: Oct. 10, 1985

[30] Foreign Application Priority Data

Mar. 29, 1984 [FR] France ..... 84 04902

[51] Int. Cl.[4] ..... C23C 1/00; B05D 1/18

[52] U.S. Cl. ..... 427/431; 427/434.2

[58] Field of Search ..... 427/433, 431, 434.2

[56] References Cited

U.S. PATENT DOCUMENTS 3,758,333 9/1973 Herman ..... 427/433

FOREIGN PATENT DOCUMENTS 1538560 7/1968 France .

OTHER PUBLICATIONS

Smith, IBM Tech. Dis. Bul., vol. 8, No. 11, Apr. 1966, p. 1639.

*Primary Examiner*—Richard Bueker

*Attorney, Agent, or Firm*—Gerald J. Ferguson, Jr.; Michael P. Hoffman; Ronni S. Malamud

[57] ABSTRACT

The invention consists in a process for consecutively coating a metal band with at least two different coating alloys, on one production line, whereby, to pass from a first product to the second, a secondary tank (8) containing the second alloy is disposed in the main tank (2).

The process is used for the continuous production of coated metal sheets.

4 Claims, 2 Drawing Figures

PROCESS OF GALVANIZING FOR CONSECUTIVELY PRODUCING TWO DIFFERENT COATINGS ON A METAL BAND

The present invention relates to a process of galvanizing for consecutively producing two different coatings on a metal band.

Coating of a metal band with a zinc alloy is at present effected by means of an installation called a galvanizing line along which the band moves and undergoes various treatments. An unwinding station at the beginning of the line is successively followed by a cleaning station, a pre-heating station with or without control of atmosphere, a so-called laboratory station where heating of the band is generally continued in a highly reducing atmosphere, possibly a cooling station and finally a bath of molten zinc alloy. On leaving the bath, the band is dried and cooled before being wound or conducted through subsequent treatment stations (such as for example heat treatment or surface treatment stations . . . ).

It will be readily appreciated that such a galvanizing line is a complex installation intended for continuous mass production of a single product. Now, it may be advantageous to be able to manufacture products whose coatings are different. On the same galvanizing line, in addition to the adjustment of all the treatment stations upstream of the bath of alloy, this modification requires the emptying of the tank containing this bath, which is a delicate, long and therefore expensive operation, taking into account in particular the heating means employed (induction) which function correctly only in the presence of a bath in the tank. In addition, the correctly emptied tank must be subjected to an extremely thorough cleaning, in certain cases, in order thereafter to be able to receive the new coating alloy which may possibly not tolerate, even at a very low concentration, one or more of the elements constituting the preceding alloy.

The manufacture of two different products has therefore often required the use of two galvanizing lines, each especially provided for one or the other of the products. It will be readily appreciated that this solution involves considerable investment which can be justified only by intensive mass production. Furthermore, two tanks have been provided on the same line, which may be alternately put into service by translation transverse to the direction of advance of the metallic band. However, this solution presents the drawback of immobilizing large quantities of molten metal and of having to maintain in the molten state one bath out of use whilst the other is being used, with the energy consumption that this represents.

It is an object of the invention to propose another solution for the successive production, on the same galvanizing line, of two different products, i.e. coated with different alloys, by means of a galvanizing process. The arrangements of the invention advantageously allow a change of bath with a minimum of handling of molten metal, a maximum of safety, particularly for the device for maintaining temperature, and finally in a relatively short time, i.e. without appreciable influence on the production capacity and therefore on the cost price of the finished product.

To this end, the invention relates to a process for consecutively producing on a single production line at least two metal band products coated with different metal alloys, the production line comprising in particular a fixed tank of molten alloy in which the metal band advances.

According to one of the principal features of the invention, this process consists, in order to pass from the first to the second product, in placing in the bath of said fixed tank a removable tank of smaller volume containing one of the said alloys different from that contained in the fixed tank, in maintaining the temperature of the bath of the removable tank by regulating the temperature of the bath of the fixed tank and in advancing said metal band in the bath of the removable tank, and, to pass from the second to the first product, in withdrawing said removable tank, the metal band then advancing in the fixed tank.

In this process, it is advantageous to constitute at least one start of bath in the removable tank before this tank is positioned in the bath of the fixed tank.

One of the phases of the process resides in the fact that, prior to the positioning of the removable tank, the fixed tank is partially emptied then, after this positioning, the two baths are completed up to an identical level.

The invention will be more readily understood on reading the following description with reference to the accompanying drawings, in which.

Figure 1:
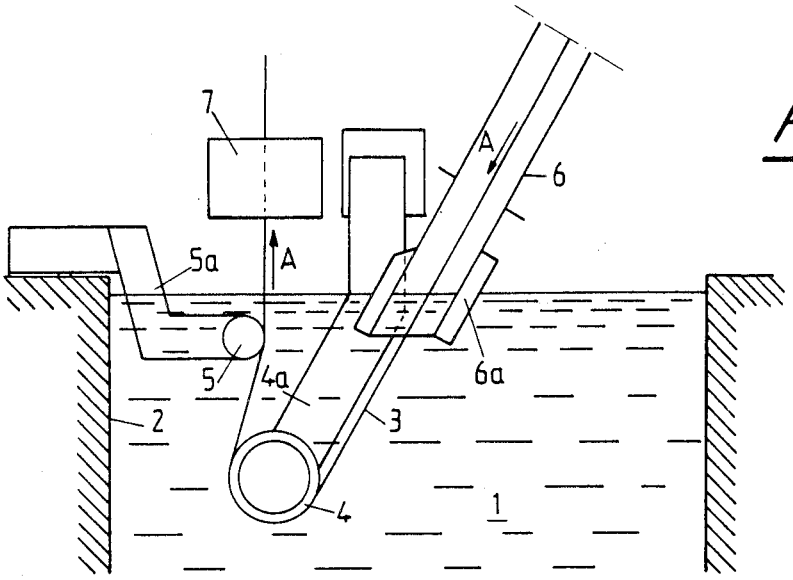
FIG. 1 is a schematic view in section of a known galvanizing installation in the zone of the bath of molten alloy.

Referring now to the drawings, FIG. 1 shows a portion of galvanizing line at the level of the bath of molten zinc alloy. This bath 1 is contained in a fixed tank 2 which is provided with heating elements known per se, such as inductors (not shown).

The means for guiding the metal band 3 in the bath 1 whilst it is circulating in direction A are constituted by a guide roller 4 immersed in this bath, by which the band passes from its downward path to its substantially vertical path of extraction. Such guiding is completed by a straightening roller 5.

The band 3 is thus brought into the bath, in known manner, through an atmosphere-confining jacket 6 having one end 6*a* immersed in the bath in order to ensure tightness of the volume inside the jacket with respect to the outside. On leaving the bath, beyond the roller 4, the band penetrates into a drying device 7 which may be mechanical by rollers or by projection of gas. It will be noted that roller 4 (and roller 5) is borne by an arm 4*a* (5*a* for roller 5) which is dismountably fixed to a fixed structure of the line extending above the tank 2 and which also bears the jacket 6.

Figure 2:
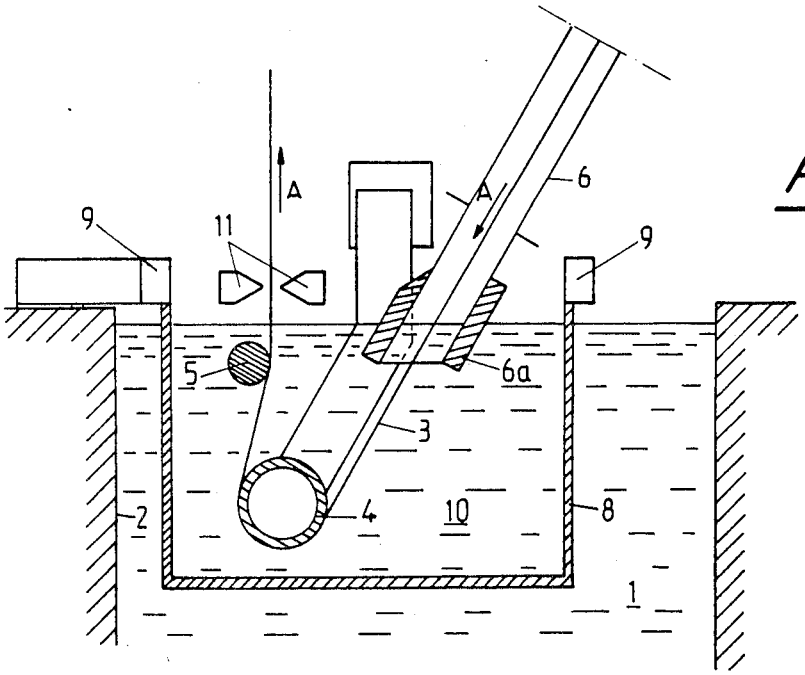
FIG. 2 illustrates by the same schematic section an installation for carrying out the process according to the invention.

FIG. 2 shows a galvanizing line structure at the level of the bath 2 of molten alloy which is substantially identical to that of FIG. 1, at least in its principal components. However, it will be noted that the end 6*a* of the jacket 6 and the rollers 4 and 5 are assembled in a zone of the bath 1 of predetermined volume. This volume must be smaller than the inner volume of a removable tank 8 which may be suspended in the fixed tank 2 by means of fixed suspension devices (shown by a frame 9) which extend above the tank 2 and which are fast with the said fixed structure. When the tank 8 is in place, its position with respect to the tank 2 is such that it is almost entirely immersed in the bath 1 of molten alloy which constitutes a means of heat transfer between the fixed means for heating by induction of the tank 1 and a bath 10 contained in the tank 8. It is therefore advantageous to have available the maximum of contact surface between the tank 8 and the bath 1, therefore to immerse it to a maximum. Nevertheless, an additional heating means, fast with tank 8, may be provided.

Access to the fixed tank 2 must be cleared in order to position the removable tank 8. To this end, the rollers 4 and 5 will have been provided to be dismountable, as well as the nozzles 11 for blowing drying gas, slidably mounted on rails (not shown) transverse to the direction of advance of the band. As far as the jacket 6 is concerned, it may be adapted to be retracted via an appropriate articulation on the fixed structure, it may be of telescopic construction, or an easily dismountable lower part bearing the end *6a* (or shoe) may be provided.

The process according to the invention is carried out with an installation in accordance with that of FIG. 2. In the absence of the removable tank 8, the metal band is immersed in the bath of alloy 1 and is therefore coated with a first coating characterizing a first product issuing from the galvanizing line.

A second product, differing from the first by a coating of different nature, may be produced on the same line. After the latter has been stopped, it suffices to dismantle or retract the members 4, 5, 6, 7 and/or 11 and, by means of a lifting bridge, to advance the tank 8 towards the fixed tank 2 whose contents will have been partially emptied. The tank 8 will preferably contain a start of bath 10 of a second alloy which will have been created for example by means of an oven or by means of an auxiliary heating that it may comprise. In fact, it is known that ingots melt more rapidly when they are in contact with a bath which has already been created. The tank 8, then fixed to devices 9, dips in the part of bath 1 remaining in the tank 2 which brings it the calories necessary for maintaining the beginning of bath. The members 4, 5, 6, 7 and/or 11 are then returned into position and each of baths 1 and 10 is completed by adding ingots or, for bath 1, part of the portion emptied from the initial bath which will have been maintained in the liquid state. The metal band then passes into bath 10 and is coated with the second alloy.

It is a relatively rapid operation to bring the auxiliary tank into service, and the time during which the galvanizing line is stopped does not greatly increase the cost price of the product. In addition, the process according to the invention makes it possible to pass from one alloy to another without danger since the latter are contained in two different tanks without any possible solution of a component of the first bath in the second. For example, sheets coated with an alloy containing lead and with a zinc-aluminium alloy in which it is known that lead must be exempt, may therefore be produced on the same line.

The invention is not limited to the embodiment which has just been given but, on the contrary, covers all the variants which may be made thereto without departing from its scope.

I claim:

1. In a process for producing at least two metal band products coated with different metal alloys on a single production line including a fixed tank of molten alloy through which a metal band passes, the improvement which comprises, in order to change from a first to a second product, placing a removable tank of smaller volume than the fixed tank in the molten alloy of said fixed tank, said removable tank containing an alloy different from that contained in the fixed tank, and passing the metal band through a molten alloy in said removable tank, whereby different parts of said band are coated with different alloys.

2. A process according to claim 1 including maintaining the temperature of the molten alloy in said removable tank by regulating the temperature of the alloy in said fixed tank.

3. A process according to claim 1 including forming a molten alloy in said removable tank before placing it in said fixed tank.

4. A process according to claim 1 including, prior to placing said removable tank in said fixed tank, partially emptying said fixed tank and then adjusting the level of molten alloy to be the same in both tanks.

* * * * *